US007927175B2

(12) United States Patent
Coffey

(10) Patent No.: US 7,927,175 B2
(45) Date of Patent: Apr. 19, 2011

(54) WATER TOY

(76) Inventor: Larry Coffey, Muncie, IN (US)

( * ) Notice: Subject to any disclaimer, the term of this patent is extended or adjusted under 35 U.S.C. 154(b) by 189 days.

(21) Appl. No.: 11/935,676

(22) Filed: Nov. 6, 2007

(65) Prior Publication Data

US 2009/0117822 A1 May 7, 2009

(51) Int. Cl.
*A63H 33/30* (2006.01)

(52) U.S. Cl. ..... 446/473; 222/79; 472/128; 273/349; 446/153

(58) Field of Classification Search ..... 446/473, 446/153; 222/79, 78, 192; 273/349, 445; 272/1 B; 472/128
See application file for complete search history.

(56) References Cited

U.S. PATENT DOCUMENTS

| | | | | | |
|---|---|---|---|---|---|
| 2,874,967 | A | | 2/1959 | Thereau et al. | |
| 3,721,038 | A | | 3/1973 | Viczena | |
| 3,823,847 | A | * | 7/1974 | Ware | 222/79 |
| 4,223,894 | A | | 9/1980 | Fabricant | |
| 4,689,032 | A | | 8/1987 | Trossman | |
| 4,925,181 | A | | 5/1990 | Anderson | |
| 5,009,413 | A | | 4/1991 | Allen | |
| 5,411,269 | A | * | 5/1995 | Thomas | 273/349 |
| 5,415,214 | A | * | 5/1995 | Bock et al. | 150/168 |
| 5,417,434 | A | | 5/1995 | Romero | |
| 5,611,460 | A | * | 3/1997 | Rudell | 222/78 |
| 5,823,849 | A | * | 10/1998 | Gardner et al. | 446/473 |
| 5,928,053 | A | | 7/1999 | Henderson | |
| 5,976,720 | A | * | 11/1999 | St. Jean et al. | 429/7 |
| 6,012,960 | A | | 1/2000 | Lee | |
| 6,027,393 | A | | 2/2000 | O'Rourke | |
| 6,158,669 | A | * | 12/2000 | Louis | 239/146 |
| 6,280,277 | B1 | | 8/2001 | Greenberg et al. | |
| 6,296,540 | B1 | | 10/2001 | LaPlanca et al. | |
| 6,482,058 | B2 | | 11/2002 | Sanso et al. | |
| 6,533,282 | B2 | * | 3/2003 | Rudell et al. | 273/445 |
| 6,551,193 | B1 | | 4/2003 | Edwards | |
| 6,905,388 | B2 | | 6/2005 | Schoonmaker | |
| 7,052,347 | B2 | | 5/2006 | Goldmeier | |
| 7,504,025 | B2 | * | 3/2009 | Burgassi | 210/122 |
| 7,731,064 | B2 | * | 6/2010 | Chuang et al. | 222/321.1 |
| 2002/0179728 | A1 | * | 12/2002 | Beidokhti | 239/20 |
| 2003/0082987 | A1 | * | 5/2003 | Baumgartner et al. | 446/175 |
| 2005/0085155 | A1 | | 4/2005 | Diffley | |
| 2005/0184098 | A1 | * | 8/2005 | Dixon | 222/192 |
| 2006/0060604 | A1 | | 3/2006 | Orlowski | |
| 2007/0056986 | A1 | * | 3/2007 | Berman | 222/79 |
| 2007/0105476 | A1 | | 5/2007 | Angelovich et al. | |

OTHER PUBLICATIONS

"Swimways Remote-Controlled Water Cannon" by The Green Head, thegreenhead.com, pp. 1-4, Sep. 2007.*

* cited by examiner

*Primary Examiner* — Gene Kim
*Assistant Examiner* — Matthew B Stanczak
(74) *Attorney, Agent, or Firm* — Woodard, Emhardt, Moriarty, McNett & Henry, LLP

(57) ABSTRACT

A water toy includes a pump and a water inlet in fluid communication with the pump, the water inlet being submerged in a water environment during use of the water toy. The water toy further includes a water gun barrel and a water gun trigger operatively coupled to the pump outlet. The pump is configured to draw water through the water inlet from the water environment, whereby activation of the trigger causes water to discharge from the water gun barrel. The water toy may also include a docking station for storage and battery recharging.

21 Claims, 7 Drawing Sheets

WATER TOY

FIELD OF THE INVENTION

The present invention relates to a water toy, and more particularly to a buoyant water gun toy having an electromechanical operating system which provides a continuous stream of water controlled by a user, the water being drawn from the surrounding water environment.

BACKGROUND OF THE INVENTION

It is commonly known that children and adults alike enjoy numerous activities associated with water play that include the use of flotation devices, water toys, water pistols and guns, sprinklers and the like. Many present water toys having a buoyant body with a water gun include hand operated water pumps, producing only a limited stream of water out the water gun before refilling or pumping is again required. Certain of the devices further require that a user regularly refill the water tank or cartridge of the water gun as water is used. Certain devices also require a level of pumping effort that young children find to be difficult or impossible to manage.

There is therefore a need for a water toy embodying a water gun which minimizes the physical effort required of the user in order to operate the water gun. The present disclosure is directed toward devices which meet these needs and others.

SUMMARY OF THE INVENTION

In one aspect of the present disclosure, a water toy comprises a pump having a pump inlet and a pump outlet, a battery electrically connected to the pump, and a water inlet in fluid communication with the pump inlet, with the water inlet being submerged in a water environment during use of the water toy. The water toy further comprises an accumulator having a predetermined pressure level, the accumulator having an accumulator inlet operatively coupled to the pump outlet and an accumulator outlet, and an electrically-actuated water valve having a water valve control input, a water valve inlet operatively coupled to the accumulator outlet, and a water valve outlet. Additionally, the water toy comprises a water gun barrel operatively coupled to the water valve outlet and a trigger operatively coupled to the water valve control input. The pump is configured to pull water through the inlet from the surrounding water environment, through the pump and into the accumulator when the pressure in the accumulator falls below the predetermined pressure level, whereby activation of the trigger causes water to discharge from the water gun barrel.

In another aspect of the present disclosure, a water toy includes a pump and a water inlet in fluid communication with the pump, the water inlet being submerged in a water environment during use of the water toy. The water toy further includes a water gun barrel and a water gun trigger operatively coupled to the pump outlet. The pump is configured to draw water through the water inlet from the water environment, whereby activation of the trigger causes water to discharge from the water gun barrel.

In yet another aspect of the present disclosure, a water toy comprises a buoyant water gun assembly having a water gun barrel, a trigger and a retractable shield positionable at lowered and upright positions. The assembly is configured to float in a body of water. Additionally, the shield is connected to the assembly with a powered hinge. In certain embodiments, the buoyant water gun assembly includes a sensor disposed thereon, such that the powered hinge is configured to lower the shield from the upright position to the lowered position as a result of a command signal sent from the sensor.

DESCRIPTION OF THE ILLUSTRATED EMBODIMENTS

Figure 1:
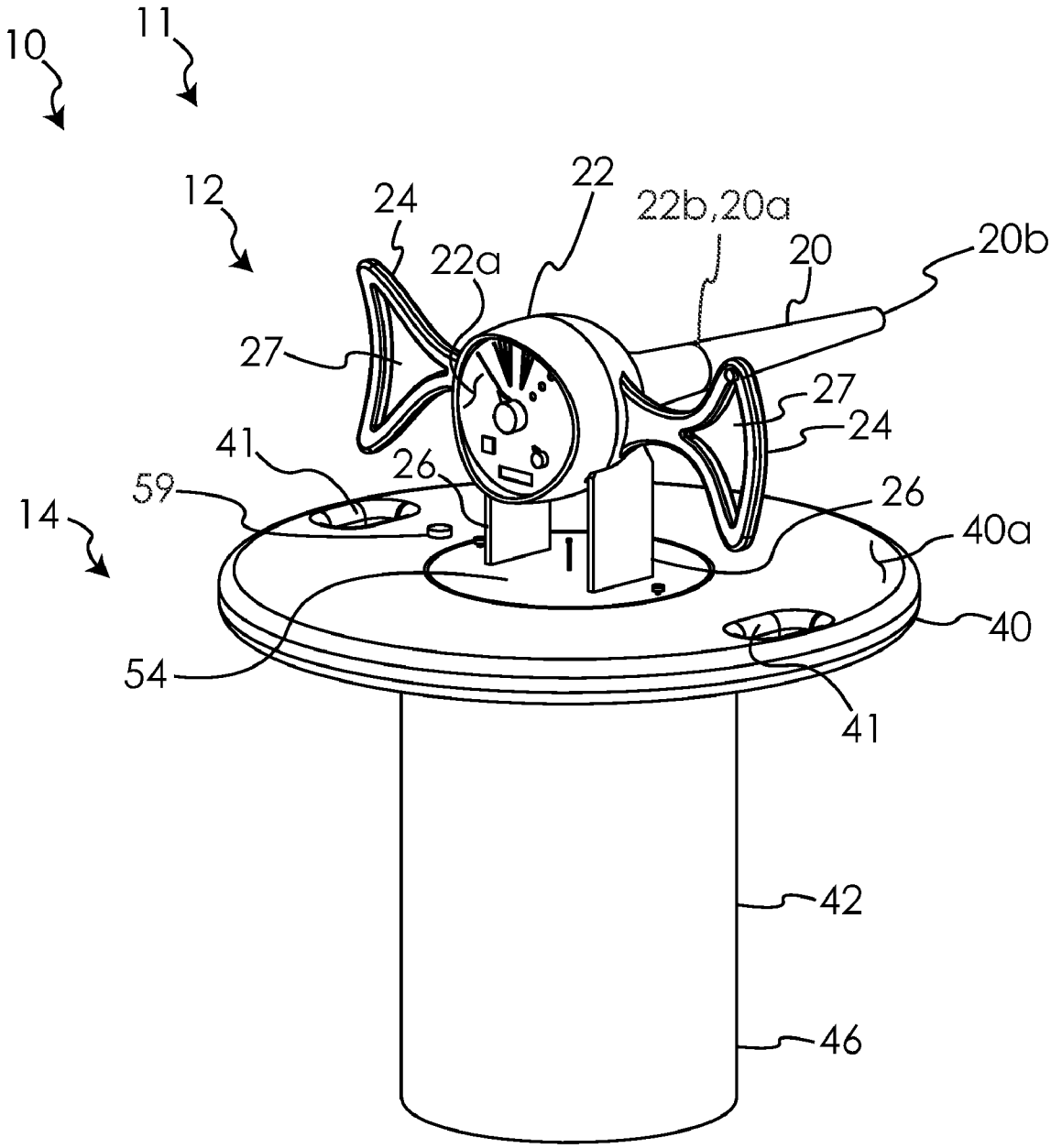
FIG. 1 is a perspective view of a water gun assembly according to an embodiment of the present invention.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, and alterations and modifications in the illustrated systems, and further applications of the principles of the disclosure as illustrated therein are herein contemplated as would normally occur to one skilled in the art to which the disclosure relates.

The present disclosure is directed to a water toy with a buoyant body embodying a water gun assembly. The water gun assembly is configured to float in a water environment. Additionally, the assembly includes an electromechanical operating system operable to draw water from the water environment and provide a stream of water flow out the water gun upon activation by a user. In certain embodiments, the water gun assembly includes a corresponding docking station for storage of the assembly and recharging of the one or more batteries of the assembly.

Figure 2:
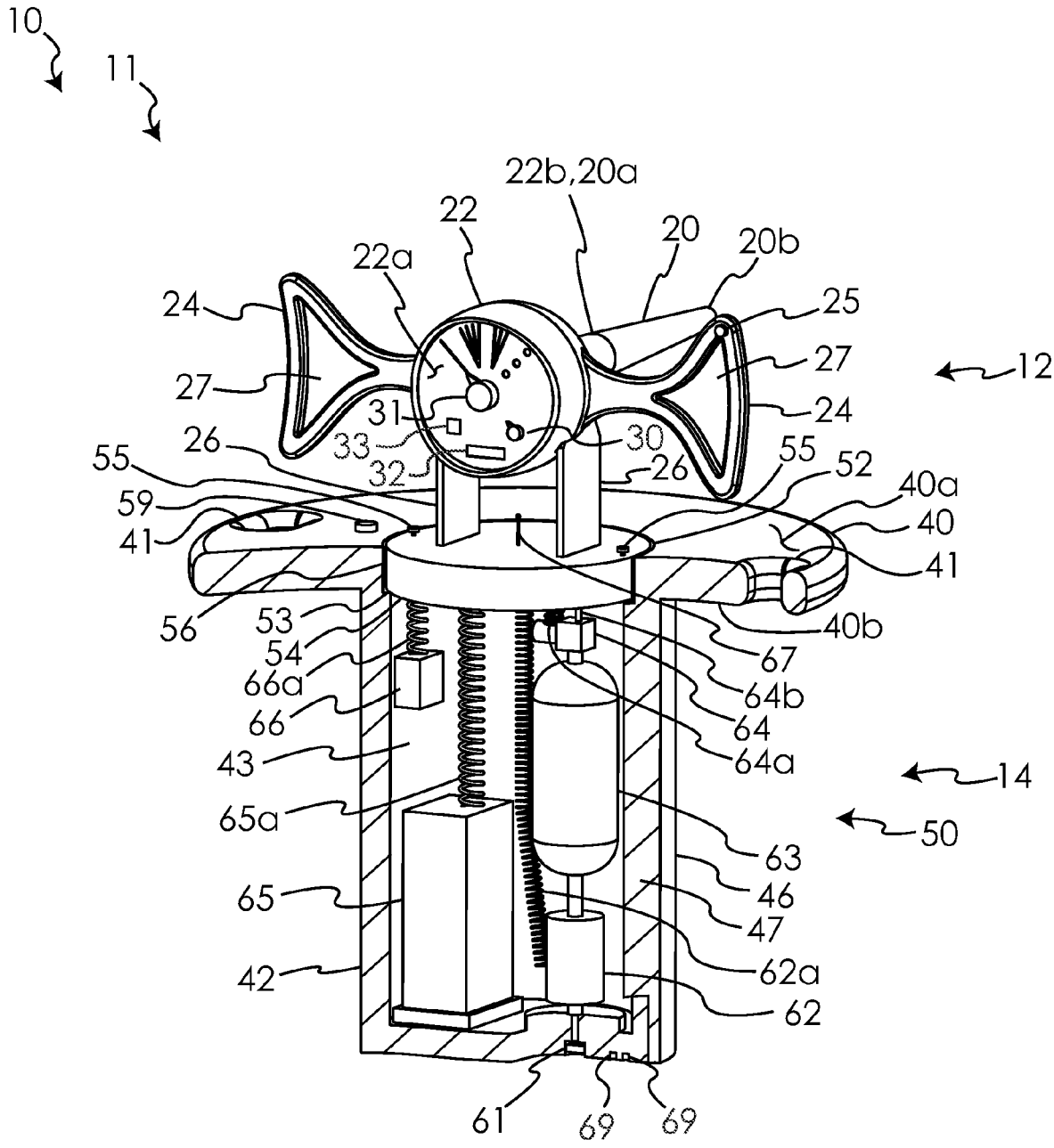
FIG. 2 is a perspective, partial cross-sectional view of a water gun assembly according to an embodiment of the present invention.

Referring to FIGS. 1 and 2, there is shown a water toy 10 including a buoyant body shown as a water gun assembly 11. Water gun assembly 11 includes an upper portion 12 embodying a water gun and a housing or lower portion 14 housing an electromechanical operating system for the water gun assembly. Upper portion 12 includes a water gun barrel 20, a water gun head 22 and handles 24. Water gun barrel 20 includes a proximal end 20*a* and a distal end 20*b*. As illustrated, water gun barrel 20 may be generally elongated and configured such that water exits from water gun assembly 11 through distal end 20*b*. Water gun head 22 includes a proximal end 22*a* and a distal end 22*b* adjacent proximal end 20*a* of water gun barrel 20. As illustrated, barrel 20 and head 22 may be separate components connected together, with barrel 20 being removable from assembly 11 for better storage or replacement if necessary. In other embodiments, barrel 20 and head 22 are portions of an integral component.

As illustrated, various user controls may be disposed on proximal end 22*a* of water gun head 22. Examples of such user controls include an on/off button 30, a spray select dial 31, a battery level indicator 32 and various other controls as would occur to one skilled in the art. In certain embodiments, on/off button 30 may also embody a mode select button, or such a mode select button may be a separate user control, to select the type of mode for which the assembly will be used including more complex competition settings involving hits and time outs. The spray select dial 31 may include settings such as pulsating, normal spay, narrow versus wide spray, and water pellets, as examples. Additionally, a hit counter 33 may be shown on proximal end 22*a* which displays the number of hits from an opponent that assembly 11 has received.

Handles 24 extend from the sides of water gun head 22 and define holes 27 to enable a user to wrap his hands around handles 24 for better control of the water gun assembly. Additionally, assembly 11 includes a trigger button 25 disposed on one of the handles 24 enabling a user to activate the water gun assembly. In the illustrated embodiment, head 22 is mounted on lower portion 14 via fulcrum posts 26. However, it should be appreciated that in other embodiments, water gun head 22 may be mounted on lower portion 14 via other mounting mechanisms.

Lower portion 14 includes a floating platform 40, a submerged portion 42 extending below the platform and a water tight access door 54. Floating platform 40 includes an upper surface 40*a* and a lower surface 40*b*. Optionally, handles 41 may extend through platform 40 to provide for easier carrying of assembly 11. As illustrated, platform 40 and submerged portion 42 may be integral portions with submerged portion 42 extending down from lower surface 40*b*. Additionally in the illustrated embodiment, platform 40 is generally ring-shaped and submerged portion 42 is generally cylindrical in shape. However, it is contemplated that lower portion 14 can be shaped and configured differently.

Submerged portion 42 includes a hollow compartment 43, accessible via access door 54, housing components of an operating system 50 operable to draw water from the surrounding water environment and provide a stream of water out distal end 20*b* of water gun barrel 20 upon activation by a user. Lower portion 14 includes solid material therein, the material being less dense than water, to provide buoyancy to water gun assembly 11. In certain embodiments, lower portion 14 includes a foam lining 47. In other embodiments, other buoyant material may be disposed in lower portion 14 providing buoyancy to the assembly to enable the assembly to float in water. As illustrated, lower portion 14 may include a plastic outer shell or case 46 surrounding foam lining 47. In the illustrated embodiment, foam lining 47 defines part of hollow compartment 43 and entirely or substantially comprises floating platform 40. In certain embodiments, water gun assembly 11 is configured, in conjunction with foam lining 47, such that floating platform 40 floats in a water environment at or on the surface of the water. However, the assembly could be configured differently such that assembly 11 is buoyant, with more or less of assembly 11 being submerged and more or less of assembly 11 residing above the water surface level.

In the illustrated embodiment, lower portion 14 defines an upper opening 52 extending through the center of floating platform 40 in communication with hollow compartment 43. As illustrated, lower portion 14 may also define an inner transitional ledge 53 between platform 40 and submerged portion 42. Access door 54 may be configured to reside in opening 52 resting partially on ledge 53, with both door 54 and opening 52 being cylindrical in shape. In the illustrated embodiment, access door 54 also serves as the base fulcrum for upper portion 12. It is contemplated that access door 54 creates a water-tight seal preventing water from entering hollow compartment 53. Optionally, a gasket 56 may be positioned about door 54 to fill the space between door 54 and the inside surface of platform 40 defining opening 52 to prevent leakage and increase the water-tight seal of door 54.

In the illustrated embodiment, door 54 is opened by partially rotating the door about a center axis to unlock the door (using a key and keyway system, not shown) and raising the door up and out of opening 52. In such embodiments, door 54 may also include locking pins 55 to assist in locking the door in the desired closed position. The illustrated manner of closing and locking door 54 is only one example of a number of different possible configurations. In other embodiments, the access door to hollow compartment 43 can pivot about a hinge to open and close the door. In even other embodiments, it is contemplated that the access door to hollow compartment 43 is offset from the fulcrum posts of the water gun, rather than directly underneath, such that the water gun of upper portion 12 does not have to be moved to access the components housed within hollow compartment 43.

As stated above, water gun assembly 11 includes an operating system 50. In the illustrated embodiment, system 50 includes a water inlet 61 leading to a pump 62, which leads to a bladder tank or accumulator 63 leading to an electrically-actuated water valve 64, and a battery 65 to power the pump 62 and various other components of assembly 11. The electrically-actuated valve 64 is electrically connected to trigger button 25. Accordingly, a user may depress button 25 which applies a voltage to activate valve 64 to release a flow of water to force a stream of water out distal end 20*b* of water gun barrel 20. In certain embodiments, the stream of water may be a continuous, constant stream during the user's depression of button 25. As illustrated, inlet 61 is submerged in the surrounding water environment so that system 50 may draw water from the surrounding water environment. As evident from the configuration of water gun assembly 11, a user of the assembly is not required to continually fill tanks or cartridges with water to provide water for the water gun. In the illustrated embodiment, bladder tank or accumulator 63 includes a predetermined pressure level, with pump 62 being configured to pump water through inlet 61 and into accumulator 63 when the pressure in accumulator 63 falls below the predetermined pressure level, the pump maintaining a relatively constant amount of pressure throughout the operation.

Additionally, in certain embodiments, inlet 61 may include a removable and/or replaceable water filter (not shown for simplicity) to filter and clean the water drawn from the surrounding water environment. Assembly 11 may also optionally include one or more water sensors 69 which are conductive contacts used to detect that assembly 11 is at least partially submerged in the water environment. In such embodiments, assembly 11 may be configured to only operate when sensors 69 detect that assembly 11 is partially submerged to preserve battery life.

In the illustrated embodiment, operating system 50 includes coiled water and electrical lines to allow a user to open and remove access door 54 without disconnecting the lines to the operating system. However, it is contemplated that in other embodiments, a quick disconnect mechanism may be incorporated into assembly 11 to disconnect the water electrical lines before opening and removing access door 54. In the illustrated embodiment, coiled electrical line 65*a* extends from battery 65 to a central electrical unit (not shown for simplicity) functioning as a port for various electrical lines necessary for the operation of water toy 10, the unit being operable to send and receive electrical signals as necessary. Additionally, coiled electrical lines 62*a* and 64*a* may extend from pump 62 and valve 64, respectively, to such central electrical unit or may extend directly to the components electrically connected with the pump or the valve. In the illustrated embodiment, there is also an electrical cable 64*b* extending from valve 64 either directly or indirectly (via a central electrical unit) to trigger button 25. In such embodiment, cable 64*b* may include slack in the cable to enable door 54 to be unlocked and removed without disconnecting the cable.

In the illustrated embodiment, the coiled water and electrical lines which necessarily extend to upper portion 12 are positioned within one or both fulcrum posts 26. However, this configuration is merely one example of numerous possible configurations. As another example, it is contemplated that the lines and cables extend up through door 54 and into the base of water gun head 22, or other locations in upper portion 12, such that the lines are open to the surrounding environment and are not contained within fulcrum posts 26. Moreover, it should be appreciated that the wiring of system 50 and the various other electrical components of water toy 10 can be configured as would generally occur to one skilled in the art.

System 50 may further include a charging port 59 electrically connected to battery 65 (directly or indirectly) to provide a connection point for a battery charger to recharge battery 65 of water gun assembly 11. Charging port 59 may include a watertight cap (not shown) to protect the port and prevent water from entering the assembly 11. Water gun assembly 11 may also optionally include a transmitter/receiver 66 with antenna 67, with a coiled electrical cable 66*a* extending up from transmitter/receiver 66 and either directly or indirectly to antenna 67. Transmitter/receiver 66 along with antenna 67 enable communication between water gun assembly 11 and one or more other water gun assemblies or various other water toys with similar communication capabilities. In certain embodiments, transmitter/receiver 66 enables two or more water gun assemblies to communicate the number of hits received on each of the assemblies.

Figure 3:
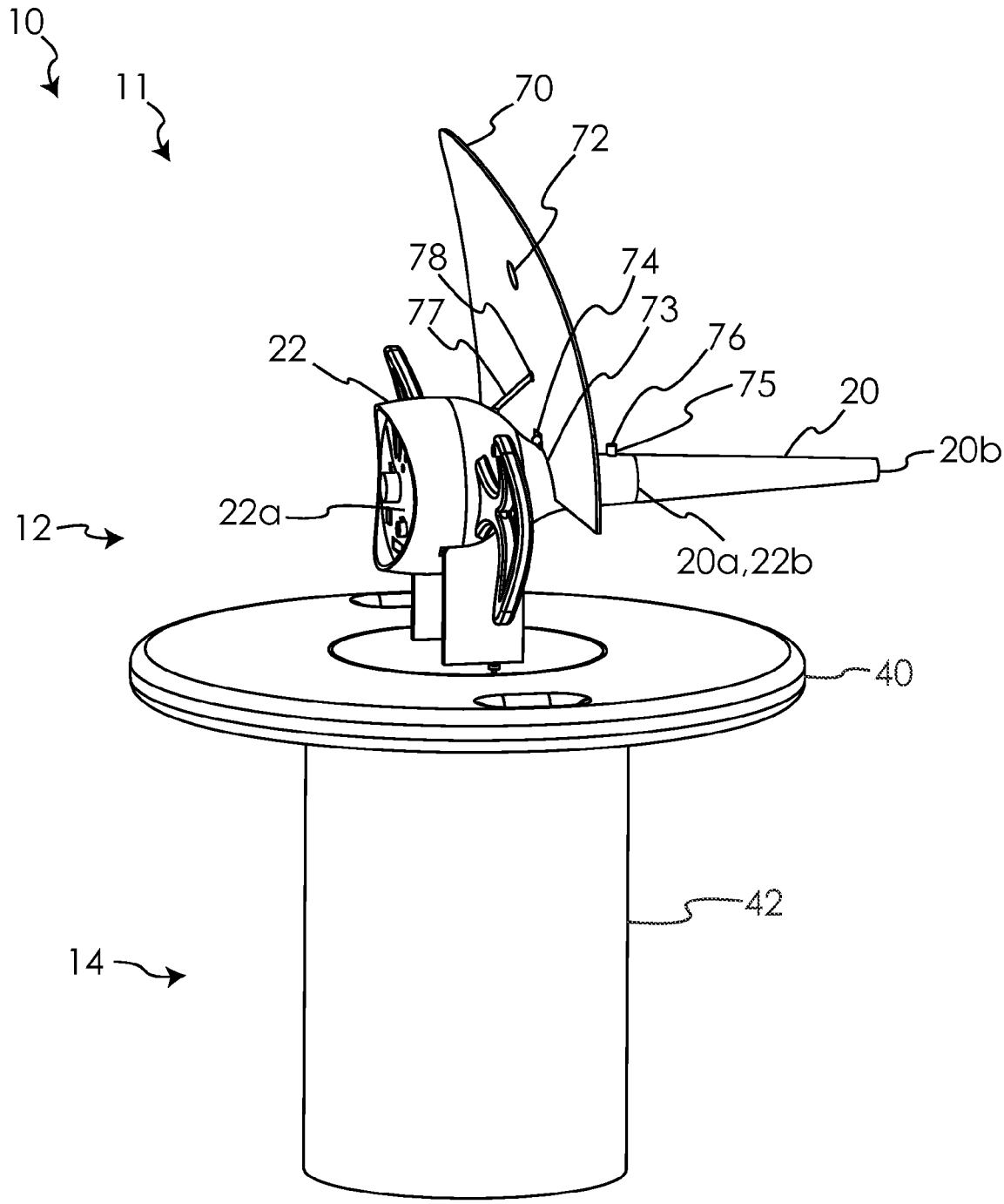
FIG. 3 is a perspective view of a water gun assembly according to an embodiment of the present invention.

Referring to FIG. 3, there is shown an embodiment of buoyant water gun assembly 11 optionally including a retractable shield 70 having a sensor 72. As illustrated, shield 70 may be generally half-circular in shape with a cutaway portion 73 for passage of water gun barrel 20. Additionally, shield 70 may be generally concave in shape, as illustrated, to assist in shielding a user from incoming water spray from an opponent. However, it should be appreciated that the size and shape of the illustrated shield 70 is merely one example and shield 70 may be shaped and configured differently.

In some embodiments, shield 70 is operably connected to a powered hinge 74 operable to raise and lower shield 70 to upright and lowered positions based on signals from sensor 72. In certain embodiments, water gun assembly 11 can be configured so that a stream of water hitting sensor 72 from an opponent player for a predetermined period of time sends command signals to activate powered hinge 74 to lower shield 70 for a certain period of time. It is contemplated that hinge 74 may be any type of hinging mechanism operable to raise and lower shield 70 upon receiving an electrical command signal.

In certain embodiments, sensor 72 is composed of two electrical conductors separated by a plastic member, with the conductors completing an electrical circuit to lower the shield when the sensor is activated. It is contemplated that sensor 72 may be a water- or pressure-sensitive sensor. Additionally, it is contemplated that sensor 72 may be disposed else on water gun assembly 11. After the set period of time has passed, shield 70 may return to the upright position. Water gun assembly may also optionally include lower and upper arms 75 and 77, respectively, having magnets 76 and 78 on the ends thereof, respectively. Arms 75 and 77 with magnets 76 and 78 can assist in maintaining shield 70 at the lowered and upright positions. In other embodiments, magnets 76 and 78 may be positioned on water gun assembly 11 with arms 75 and 77 being absent.

Figure 4:
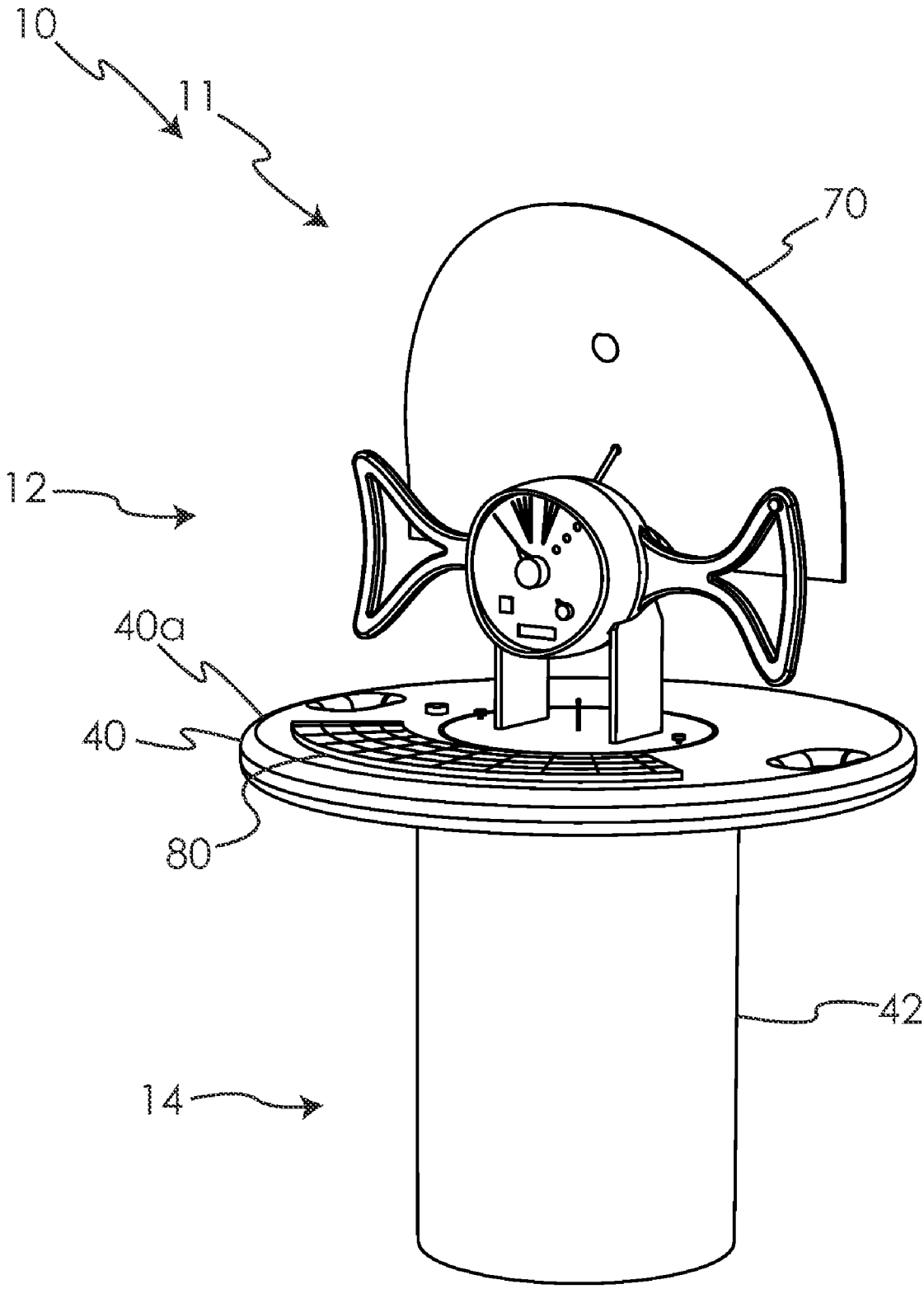
FIG. 4 is a perspective view of a water gun assembly according to an embodiment of the present invention.

As illustrated in FIG. 4, water toy 10 may optionally include a solar panel 80 to provide power to operating system 50. In such embodiments, solar panel 80 may be positioned on upper surface 40*a* of floating platform 40 so that that the solar panel 80 receives an optimum amount of sunlight when water gun assembly 11 is floating in a water environment. Solar panel 80 may be electrically connected with battery 65 so that solar panel 80 is operable to recharge battery 65. In alternative embodiments, water gun assembly 11 could be configured with solar panel 80 providing direct power to pump 62 and the various other electrical components of water gun assembly 11 requiring operating power. The illustrated embodiment shows a solar panel 80 along with a shield 70 on water gun assembly 11. However, it should be appreciated that other embodiments of water gun assembly 11 may include a solar panel 80, with shield 70 being absent.

Figure 5:
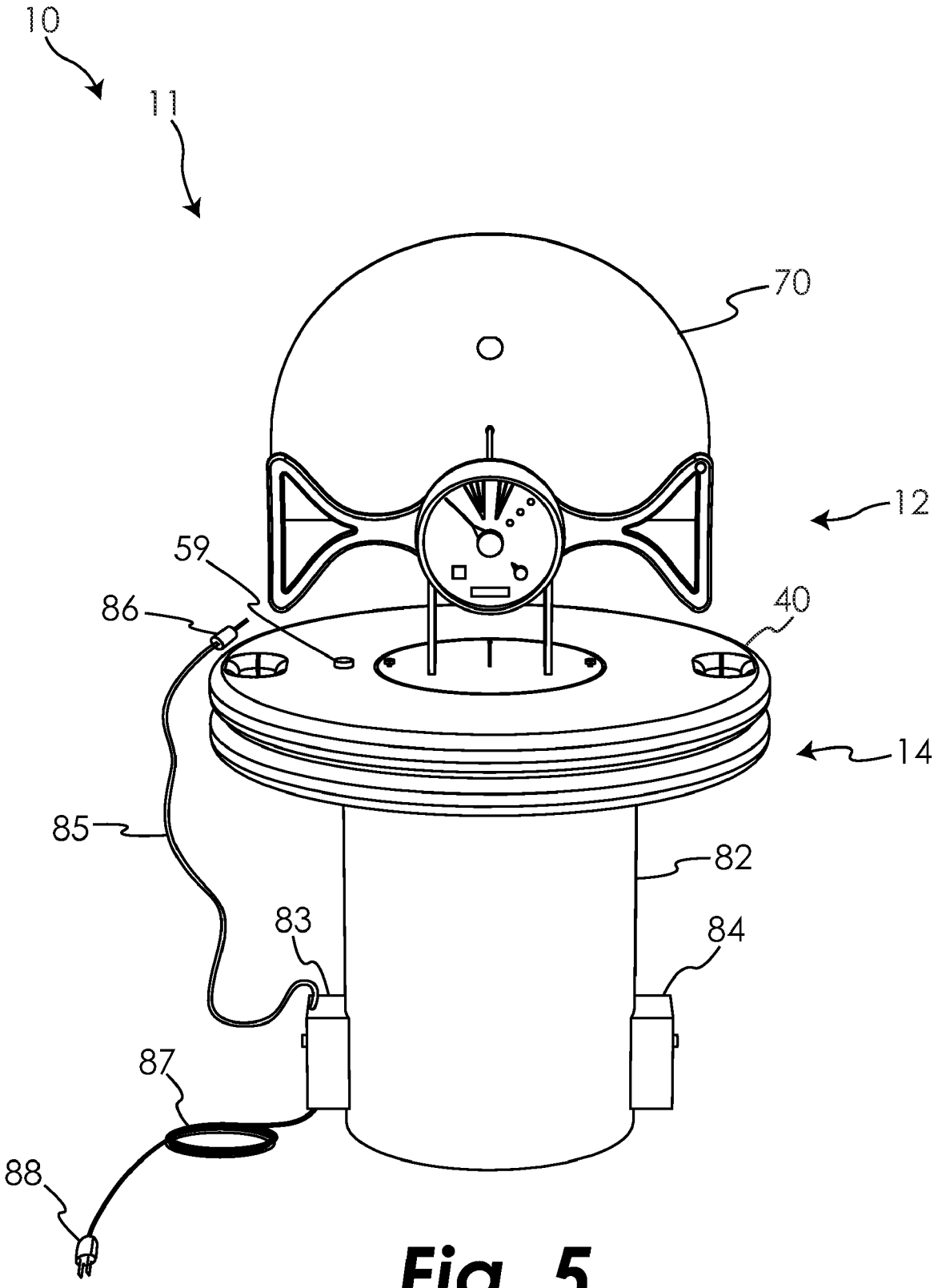
FIG. 5 is a perspective view of a water gun assembly with a docking station according to an embodiment of the present invention.

As illustrated in FIG. 5, water toy 10 may also include a docking station 82 compatible with water gun assembly 11 to secure and hold assembly 11 while charging and storing the assembly. As illustrated, docking station 82 includes a battery charger 83. In certain embodiments, battery charger 83 includes a ground fault circuit interrupter to provide protection to a user of water toy 10. Docking station 82 may also include one or more spare battery chargers 84 with the necessary electrical wiring (not shown for simplicity). Docking station 82 defines a central hole to receive submerged portion 42 such that water gun assembly 11 resides at least partially in docking station 82. Battery charger 83 includes a coiled wire 85 leading to a direct circuit plug 86 to connect with charging port 59 to connect battery charger 83 with battery 65. Additionally, battery charger 83 includes a coiled wire 87 leading to a voltage plug 88 to connect with an electrical socket to charge battery 65. In certain embodiments, voltage plug 88 may be configured to connect with a 115 volt source. Docking station 82 may also include a water drain (not shown for simplicity) at the bottom of the station so that any water on or in water gun assembly 11 may drain out of docking station 82 while the assembly is housed in the docking station.

Figure 6:
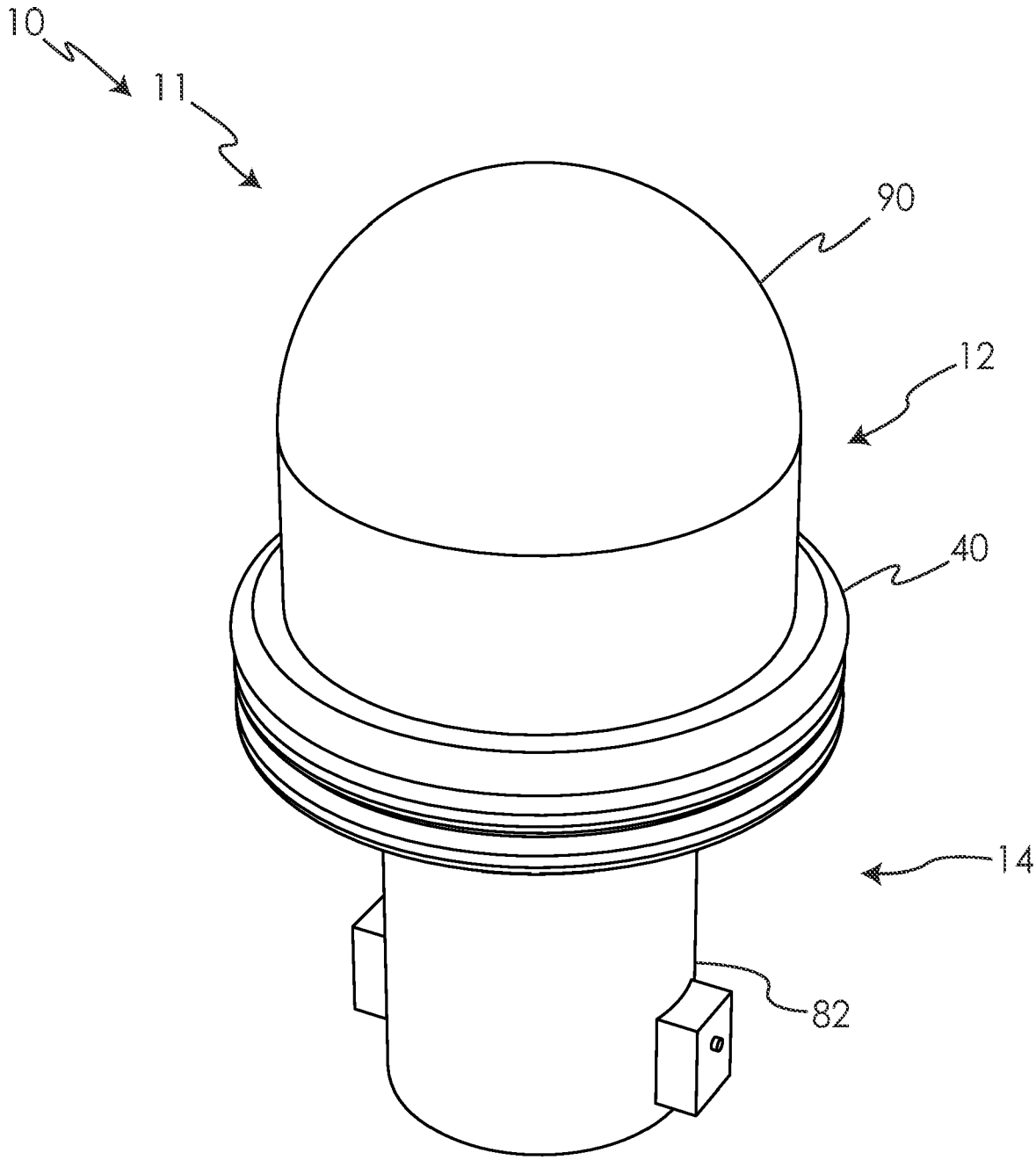
FIG. 6 is a perspective view of a water gun assembly with a docking station and a storage cover according to an embodiment of the present invention.

As illustrated in FIG. 6, water toy 10 may optionally include a cover 90 to be placed over upper portion 12 of water gun assembly 11 to protect the assembly during storage. In the illustrated embodiment, water gun assembly 11 includes shield 70 such that cover 90 is configured to be placed over and protect shield 70. In other embodiments, shield 70 is absent such that cover 90 is not required to as large to cover upper portion 12 of water gun assembly 11. In even other embodiments, cover 90 is configured to extend below upper portion 12 to also cover lower portion 14 of water gun assembly 11. Cover 90 may optionally include one or more latches (not shown for simplicity) to secure the cover to docking station 82.

Figure 7:
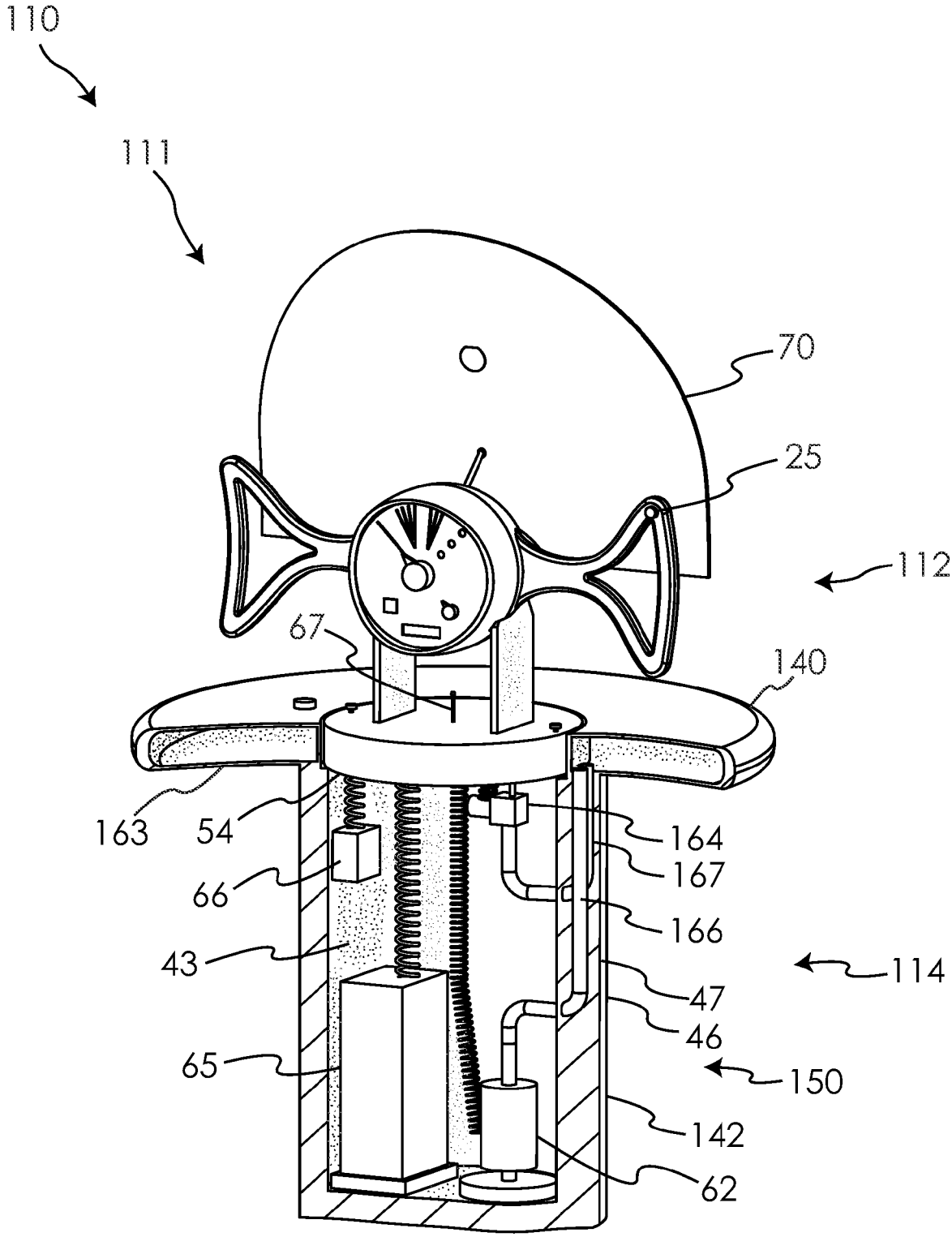
FIG. 7 is a perspective, partial cross-sectional view of a water gun assembly according to an embodiment of the present invention.

An alternative embodiment is illustrated in FIG. 7 including a water toy 110 having a water gun assembly 111. Water gun assembly 111 is similar to water gun assembly 11 in certain aspects, where like reference numerals refer to like features previously described, one difference being that bladder tank 63 is absent and a bladder ring 163 is present. Bladder ring 163 is partially charged with air and is positioned within floating platform 140 to aid in providing buoyancy to water gun assembly 111. Bladder ring 163 may include a bladder liner (not shown for simplicity) charged with air, such that the water and air within bladder ring 163 are separated.

Water gun assembly 111 includes operating system 150 having a pump 62 with a water line 166 extending from pump 162 to bladder ring 163. Additionally, a water line 167 extends from bladder ring 163 to electrically-actuated water valve 164, valve 164 being electrically connected with trigger button 25. In certain embodiments, bladder ring 163 may include a relatively large capacity for holding water to decrease the amount of work required by pump 62 and thus increase the life of battery 65. In the illustrated embodiment, bladder ring 163 supplements foam lining 47 within floating platform 140 to provide additional buoyancy to assembly 111. In other embodiments, the bladder ring may replace the foam lining 47 within floating platform 40.

It should be appreciated that assembly 111, and specifically operating system 150, can be configured differently with the components positioned at various places within assembly 111, such that bladder ring 163 is positioned within floating platform 140 and operably connected to the necessary components. Upon activation of water valve 164, a stream of water exits the water gun barrel in the same possible manners as described above in connection with assembly 11. Additionally, it is contemplated that assembly 111 may combine with a docking station, in a similar manner as assembly 11 combines with docking station 82, to store and recharge assembly 111. Assembly 111 may also optionally include shield 70 and transmitter/receiver 66 with antenna 67, as well as other components illustrated above, as described above in connection with assembly 11.

In another alternative embodiment, a buoyant water gun assembly similar to water gun assembly 11 includes an accumulator or bladder tank positioned at the bottom of the assembly, replacing bladder tank 63 of assembly 11. The alternative design of positioning the bladder tank at the bottom of the assembly may assist in providing stability to the alternative assembly, as well as allowing for an increased water-holding capacity in the bladder tank to enhance the operating system of the alternative design.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A water toy apparatus, comprising:

a pump having a pump inlet and a pump outlet;

a battery electrically connected to the pump;

a water inlet in fluid communication with the pump inlet, wherein the water inlet is submerged in a water environment during use of the water toy;

an accumulator having a predetermined pressure level, the accumulator having an accumulator inlet operatively coupled to the pump outlet and an accumulator outlet;

an electrically-actuated water valve having a water valve control input, a water valve inlet operatively coupled to the accumulator outlet, and a water valve outlet;

a water gun barrel operatively coupled to the water valve outlet;

a trigger operatively coupled to the water valve control input;

wherein the pump is configured to pull water through the inlet from the surrounding water environment, through the pump and into the accumulator when the pressure in the accumulator falls below the predetermined pressure level, whereby activation of the trigger causes water to discharge from the water gun barrel;

a shield mounted on the water gun barrel;

a powered hinge coupled to the shield and having a hinge sensor input, wherein an electrical signal provided to the hinge sensor input is operative to lower the shield; and a sensor disposed on the shield, wherein the sensor is operative to provide an electrical signal to the hinge sensor input to lower the shield when a stream of water contacts the sensor for a predetermined period of time.

2. The apparatus of claim 1, further comprising a lower portion housing which houses the water valve, the accumulator, the pump, and the battery.

3. The apparatus of claim 2, wherein the lower portion housing includes a plastic outer shell with a lining of solid material less dense than water to provide buoyancy.

4. The apparatus of claim 2, further comprising a water-tight access door in the lower portion housing to access the water valve, the accumulator, the pump, and the battery.

5. The apparatus of claim 1, further comprising a communication device electrically connected to the battery to communicate with another water toy.

6. The apparatus of claim 1, further comprising a docking station assembly to charge the battery.

7. The apparatus of claim 6, wherein the docking station assembly includes a docking station storage unit, a battery charger having a ground fault circuit interrupter, an electrical plug to connect to an electrical outlet, and a direct current plug to connect to the water gun assembly.

8. A water toy, comprising:

a pump with a pump inlet and a pump outlet;

a water inlet in fluid communication with the pump inlet, wherein the water inlet is submerged in a water environment during use of the water toy;

a water gun barrel operatively coupled to the pump outlet;

a water gun trigger operatively coupled to the pump;

wherein the pump is configured to draw water through the water inlet from the water environment, whereby activation of the trigger causes water to discharge from the water gun barrel;

a shield mounted on the water gun barrel;

a powered hinge coupled to the shield and having a hinge sensor input, wherein an electrical signal provided to the hinge sensor input is operative to lower the shield; and a sensor assembly operatively coupled to the shield, wherein the sensor assembly is operative to provide an electrical signal to the hinge sensor input to lower the shield when a stream of water contacts the sensor assembly for a predetermined period of time.

9. The water toy of claim 8, further comprising:

a battery electrically connected to the pump;

a bladder tank having a predetermined pressure level, the tank having a tank inlet operatively coupled to the pump outlet and a tank outlet; and an electrically-actuated water valve having a water valve control input, a water valve inlet operatively coupled to the tank outlet, and a water valve outlet;

wherein the trigger is operatively coupled to the water valve control input and the water gun barrel is operatively coupled to the water valve outlet.

10. The water toy of claim 9, further comprising a buoyant housing which houses the pump, the valve, the bladder tank, and the battery, and further comprising a water-tight access door in the buoyant housing to access the pump, the valve, the bladder tank, and the battery.

11. The water toy of claim 10, wherein the buoyant housing includes a plastic outer shell with a lining of solid material less dense than water to provide buoyancy to the buoyant body.

12. The water toy of claim 9, wherein the bladder tank has a predetermined pressure level and the pump is configured to pump water into the bladder tank when the pressure in the bladder tank falls below the predetermined pressure level.

13. The water toy of claim 9, further comprising a docking station assembly having a battery charger to charge the battery.

14. The water toy of claim 9, further comprising a solar panel electrically connected to the battery to power the battery.

15. The water toy of claim 8, further comprising a communication device and an antenna operatively coupled to the sensor assembly and to the battery, wherein the communication device is operative to communicate with another water toy regarding a number of times the sensor assembly has been activated.

16. A water toy, comprising:

a buoyant water gun assembly having a water gun barrel, a water gun trigger, a retractable shield positionable at lowered and upright positions, and a powered hinge having a hinge sensor input, wherein an electrical signal provided to the hinge sensor input is operative to lower the shield, wherein the assembly is configured to float in a body of water, wherein the shield is connected to the assembly with the powered hinge; and a sensor disposed on the buoyant water gun assembly, wherein the sensor is operative to provide an electrical signal to the hinge sensor input to lower the shield from the upright position to the lowered position when the sensor is contacted by water for a predetermined period of time.

17. The water toy of claim 16, wherein the sensor is mounted on the shield.

18. The water toy of claim 16, further comprising a water inlet and a pump having a pump outlet and a pump inlet in fluid communication with the water inlet, the pump being configured to pump water into the assembly through the inlet from the body of water, whereby activation of the trigger causes water to discharge from the water gun barrel.

19. The water toy of claim 18, further comprising:

an electrically-actuated water valve having a water valve control input, a water valve inlet and a water valve outlet, wherein the trigger is operatively coupled to the water valve control input and the water gun barrel is operatively coupled to the water valve outlet;

a bladder tank having a predetermined pressure level, the tank having a tank inlet operatively coupled to the pump outlet and a tank outlet operatively coupled to the water valve inlet; and a battery electrically connected with the pump.

20. The water toy of claim 16, further comprising at least one magnet disposed on the buoyant water gun assembly to assist in maintaining the shield at the upright position.

21. The water toy of claim 16, wherein the sensor includes two conductors which complete an electrical circuit to provide the electrical signal to the hinge sensor input to lower the shield when a stream of water contacts the sensor for a predetermined period of time.

* * * * *